US008419388B2

(12) United States Patent
Zippl et al.

(10) Patent No.: US 8,419,388 B2
(45) Date of Patent: Apr. 16, 2013

(54) COOLANT COMPRESSOR

(75) Inventors: Güenther Zippl, Kukmirn (AT); Walter Brabek, Furstenfeld (AT); Alfred Freiberger, Grosswilfersdorf (AT)

(73) Assignee: ACC Austria GmbH (AU)

( * ) Notice: Subject to any disclaimer, the term of this patent is extended or adjusted under 35 U.S.C. 154(b) by 64 days.

(21) Appl. No.: 12/933,237

(22) PCT Filed: Mar. 19, 2009

(86) PCT No.: PCT/EP2009/053229

§ 371 (c)(1),
(2), (4) Date: Jan. 18, 2011

(87) PCT Pub. No.: WO2009/115565

PCT Pub. Date: Sep. 24, 2009

(65) Prior Publication Data

US 2011/0103983 A1 May 5, 2011

(30) Foreign Application Priority Data

Mar. 19, 2008 (AT) ..... GM168/2008

(51) Int. Cl.
*F04B 35/04* (2006.01)

(52) U.S. Cl.
USPC ..... 417/415; 29/888.06; 417/569

(58) Field of Classification Search ..... 417/415, 417/410.1, 560, 569, 570, 571; 29/888.03, 29/888.06, 888.061
See application file for complete search history.

(56) References Cited

U.S. PATENT DOCUMENTS 3,865,345 A 2/1975 Kropiwnicki
2008/0219868 A1* 9/2008 Bonniface et al. ..... 417/415

FOREIGN PATENT DOCUMENTS

| | | | |
|---|---|---|---|
| DE | 40 22 447 | A1 | 1/1992 |
| DE | 103 23 767 | A1 | 12/2004 |
| DE | 103 30 760 | A1 | 2/2005 |
| DE | 103 42 422 | A1 | 4/2005 |
| DE | 10 2004 047159 | A1 | 4/2006 |
| DE | 10 2004 050844 | A1 | 4/2006 |
| JP | 2007-9863 | | 1/2007 |
| WO | WO 2007/011246 | A | 1/2007 |
| WO | WO 2009/115565 | A2 | 9/2009 |

OTHER PUBLICATIONS

International Search Report, PCT/EP2009/053229, ACC Austria GmbH, Sep. 14, 2009.
English Language Abstract and Computer Translation of Abstract of JP 200709863 A, Published Jan. 18, 2007, 19 pages.

* cited by examiner

*Primary Examiner* — Charles Freay
*Assistant Examiner* — Patrick Hamo
(74) *Attorney, Agent, or Firm* — McKee, Voorhees & Sease, P.L.C.

(57) ABSTRACT

A coolant compressor (1), comprising a piston-cylinder unit (2) that compresses a coolant, said piston-cylinder unit comprising a cylinder housing (4) and a piston (3) held in a piston bore (5) of the cylinder housing (4), wherein the cylinder housing (4) is sealed in an axial direction by a valve plate (6) and a cylinder cover (7). In order to facilitate the simple and flexible mounting of the valve plate (6) at the cylinder housing (4), it is provided according to the invention that the valve plate (6) is countersunk in its operating position in the piston bore (5) of the cylinder housing (4) and is fastened in the piston bore (5) of the cylinder housing (4) by way of a material bond connection, so that an end stop provided especially for the valve plate (6) in the cylinder housing (4) can be omitted.

11 Claims, 3 Drawing Sheets

COOLANT COMPRESSOR

CROSS-REFERENCE TO RELATED APPLICATIONS

Figure 1:
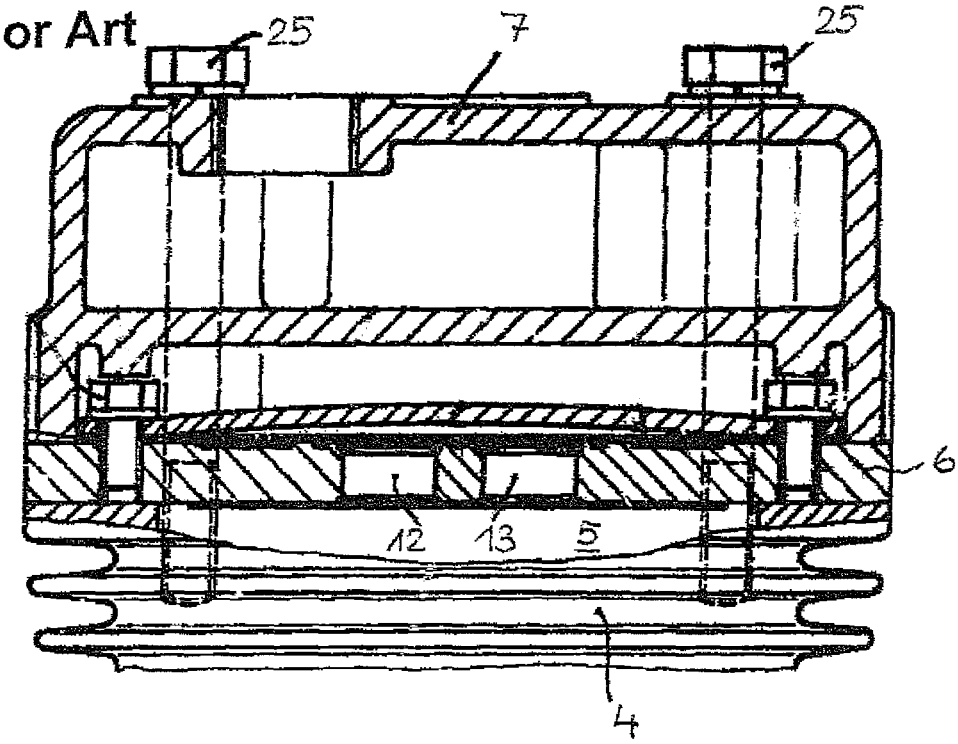
Fig.1 Prior Art

This is a National Phase application claiming priority to PCT/EP2009/053229 filed Mar. 19, 2009 which claims priority to AT GM 168/2008 filed Mar. 19, 2008, all of which are herein incorporated by reference in their entireties.

SCOPE OF THE INVENTION

The present invention relates to a coolant compressor, comprising a piston-cylinder unit that compresses a coolant, said piston-cylinder unit comprising a cylinder housing and a piston held in a piston bore of the cylinder housing, wherein the cylinder housing is sealed in an axial direction by a valve plate and a cylinder cover.

STATE OF THE ART

The refrigerating machine process using zeotropic gases has been known as such for a long time. Thereby, a coolant is heated in an evaporator by the uptake of energy from the space to be cooled and ultimately overheated, which leads to evaporation, and compressed to a higher pressure level by way of a piston-cylinder unit of the coolant compressor, where it releases heat through a condenser and is transported back into the evaporator through a throttle, in which a pressure reduction and cooling of the coolant takes place.

The piston-cylinder unit of the coolant compressor arranged in a hermetically sealed housing and powered by way of a drive motor comprises a cylinder housing and a piston held in a piston bore of the cylinder housing for compression of the coolant, wherein the cylinder housing is sealed in an axial direction by a valve plate, which is adjoined or surrounded by a cylinder cover. Screwed connections are usually used to fasten the cylinder cover or the valve plate to the cylinder housing. In this case, both the cylinder cover and the valve plate are provided mostly with four boreholes, through which relevant screw elements can be passed through and screwed into tapped holes of the cylinder housing.

Screwed connections of this type imply a high mounting and component cost, as exactly positioned tapped holes for the screw elements must be produced at first on the cylinder housing. Sealing elements are arranged between the cylinder cover and the valve plate and/or between the cylinder housing and the valve plate.

Moreover, the efficiency of generic coolant compressors is reduced by the "waste space volume", which is understood as a part of the work area of the piston-cylinder unit that does not belong to the working volume. A waste space volume of this type is caused by the arrangement of the valve plate and a necessary axial piston clearance (gap size between the piston at its top dead center and the cylinder cover or the valve plate). The gas or coolant quantity contained in the waste space volume is not discharged from the work area of the piston-cylinder unit after completion of a piston stroke and hence reduces the suction volume of the piston-cylinder unit. As a result, it is attempted to reduce the waste space volume as far as possible by providing a multitude of specially shaped sealing elements.

In addition, it is often necessary to provide centering pins at the cylinder cover or at the cylinder housing to ensure exact centering of the valve plate relative to the cylinder housing.

Moreover, the use of screwed connections has the disadvantage that the cylindrical shape of the cylinder bore is influenced in a negative way due to the forces that are transferred into the cylinder housing in places via the screw elements.

Aside from the provision of screwed connections, it is furthermore known from the state of the art to press the cylinder cover together with the valve plate onto the cylinder housing by way of a clamp element.

Hence, the objective of this invention is to reduce the component and mounting cost for the production of a generic piston-cylinder unit.

In particular, it is aimed to facilitate simple mounting of the valve plate at the cylinder housing, whereby the provision of sealing elements in the area of the valve plate can be made dispensable or the number of sealing elements at least be greatly reduced.

Moreover, it is aimed to enable best possible ideal dimensioning or greatest possible reduction of the waste space of the piston-cylinder unit.

It is aimed that the provision of screwed connections or also clamping joints for fastening the valve plate to the cylinder housing can be omitted according to the invention.

DISCLOSURE OF THE INVENTION

These aims are achieved with a coolant compressor comprising features such as follows.

In a coolant compressor, comprising a piston-cylinder unit that compresses a coolant, said piston-cylinder unit comprising a cylinder housing and a piston held in a piston bore of the cylinder housing, wherein the piston bore is sealed in an axial direction by a valve plate and a cylinder cover, it is provided according to the invention that the valve plate is countersunk in its operating position in the piston bore and is fastened in the piston bore of the cylinder housing by way of a material bond connection, thus by way of a basically non-detachable connection, in the case of which the components to be connected are held together by molecular forces, hence without the use of additional components.

Particularly simple and flexible mounting of the valve plate at the cylinder housing can thus be facilitated by fastening the valve plate at the cylinder housing by way of a binder that is fluid or viscous at least while it is processed.

Henceforth, it is possible to omit the provision of screw elements that can be screwed in the cylinder housing, as well as the provision of sealing elements arranged between the valve plate and the cylinder housing and/or between the valve plate and the cylinder cover and/or between the valve plate and the piston bore.

In addition, it is possible to omit an end stop provided especially for the valve plate as well as corresponding sealing elements for compensation of the waste space based on the fact that the valve plate is countersunk in the piston bore of the cylinder housing. In this case, the waste space can be limited to a minimum.

Depending on the relevant component geometries and the relevant manufacturing tolerances and tightness requirements desired, it is possible to select which method of material bond connection is used to fasten the valve plate, thus whether the valve plate is welded, soldered or glued onto the cylinder housing.

In a first preferred design variant of the invention, the material bond connection is a welded joint. Fastening of the valve plate in the piston bore by way of welding engineering is easy to produce and guarantees a high sealing effect.

In a second preferred design variant of the invention, the material bond connection is a soldered joint. High tightness of the piston work area bounded by the valve plate can be guaranteed also if solder is used as a binder between the valve plate and the cylinder housing, particularly as the fluidized solder fits into clearances or gaps existing between the valve plate and the piston bore in an ideal manner. As the areas of the valve plate and the piston bore to be soldered together are not heated up to their liquidus temperature during the soldering process, no distortion of the valve plate or the piston bore must be feared.

Gluing represents a particularly advantageous option for connection of the valve plate to the piston bore. By fastening the valve plate at in the piston bore by way of a glued joint according to a third design variant, it is possible to maintain an unchanged surface and structural constitution of the areas of the valve plate and the piston bore to be glued together. As the glue used as a binder between the valve plate and the piston bore is heated only to a temperature that is not of relevance for deformation of the valve plate or the piston bore (or the glue is applied cold), heat distortion of the valve plate or the piston bore during the gluing process is ruled out.

Moreover, a particularly equal distribution of tension between the valve plate and the piston bore is given by the use of a glued joint.

In the case of a particularly preferred embodiment of the invention, wherein the valve plate is designed as a single piece together with the cylinder cover, it is possible to omit the provision of a separate cylinder cover. In other words, the valve plate also takes over the task of the cylinder cover in the case of such a design. The piston bore is thus sealed exclusively by a valve plate covering the entire cross-section of the piston bore. Naturally, a separate cylinder cover that borders to or surrounds the valve plate can still be provided however, also in the case that the valve plate is fastened according to the invention.

As the component and mounting cost is reduced significantly in comparison with known valve plate arrangements as a result of fastening the valve plate according to the invention, a cost-effective production of generic piston-cylinder units is enabled.

It must be listed as another advantage of a valve plate fastened in the piston bore by way of a material bond connection or by way of a welded, soldered or glued joint according to the invention that ideal dimensioning of the waste space of the piston-cylinder unit is now enabled.

A particularly preferred embodiment of the invention is characterized in that a gap is designed between the outside circumference of the piston bore and the outside circumference of the valve plate, in which it is possible to take up a binder layer provided for formation of the material bond connection (thus a weld seam, a solder layer or a glue layer). The provision of a defined gap for uptake of a binder layer makes it possible to apply the respective binder selected using a respectively necessary layer thickness to be determined by way of a calculation of stability.

To ensure that the binder layer corresponding with the relevant connection method connects durably to the piston bore and the valve plate, said gap is provided with a wedge-shaped course that tapers in the direction of the peripheral wall of the piston bore in a particularly preferred embodiment of the invention.

According to a preferred construction method, the wedge-shaped course of the gap results from a chamfer provided at the periphery of the valve plate. By the provision of a chamfer, the surface provided on the valve plate is increased onto which the binder layer is applied, so that the stability properties of the material bond connection or the welded, soldered or glued joint are also increased.

The binder layer provided for formation of the material bond connection preferably runs along the entire circumference of the valve plate.

According to a special design variant of the invention, it is also possible however that a binder layer provided for formation of the material bond connection is arranged merely in sections along the circumference of the valve plate. Such a particularly material-saving option of merely sectional fastening of the valve plate can be used in particular, if the valve plate is sealed towards the piston bore along its circumference by way of a sealing element.

Another aspect of the invention relates to a method for fastening a valve plate at a cylinder housing of a coolant compressor, wherein the cylinder housing is provided with a piston bore for the uptake of a piston that oscillates therein, and wherein a distance between the face of the piston positioned at its top dead center and a first face of the valve plate facing the piston is provided for the formation of a waste space volume, thus a space inside the cylinder housing that does not belong to the working volume of the piston. According to the invention, it is provided that the valve plate is pushed into the piston bore in an axial direction while it is mounted, until a relevant defined distance or a desired waste space volume is created between the face of the piston positioned at its top dead center and the first face of the valve plate facing the piston, and the valve plate is welded or soldered or glued on at this position in the piston bore of the cylinder housing. This way, it is possible to limit the waste space volume inside the cylinder housing exactly without the need of providing compensating sealing elements.

SHORT DESCRIPTION OF FIGURES

Figure 2:
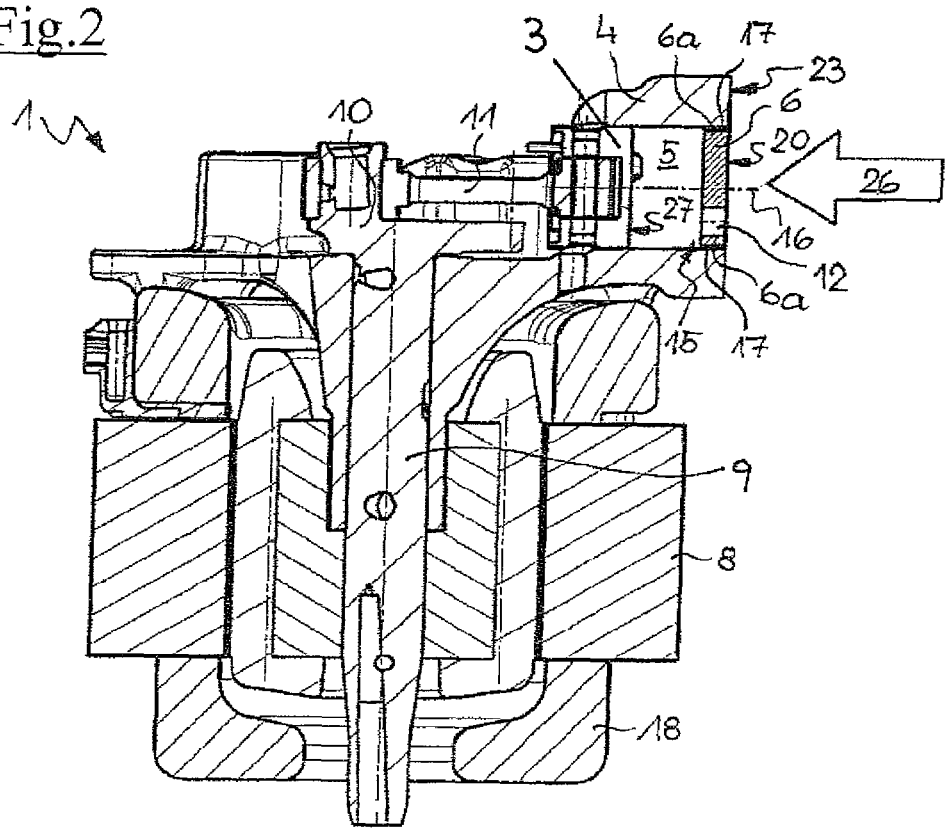
Figure 3:
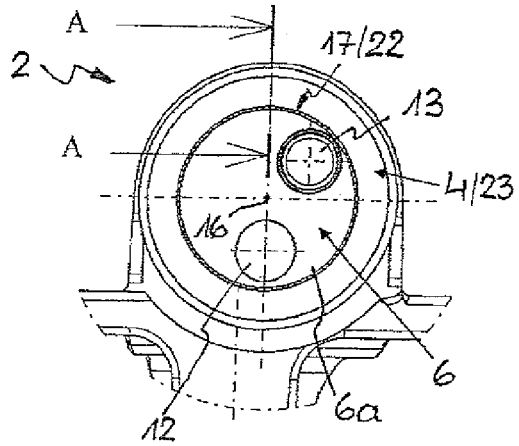

The invention is now explained in more detail on the basis of an embodiment. Thereby, the figures show:

FIG. 1 a sectional drawing of a cylinder head arrangement of a coolant compressor according to the state of the art FIG. 2 a sectional drawing of a coolant compressor according to the invention FIG. 3 a top view of the piston-cylinder unit of a coolant compressor according to the invention in accordance with viewing direction 26 in FIG. 2

Figure 4:
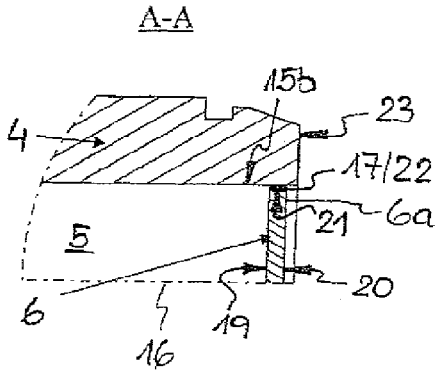

FIG. 4 a sectional drawing of the piston-cylinder unit along line A-A in FIG. 3

Figure 5:
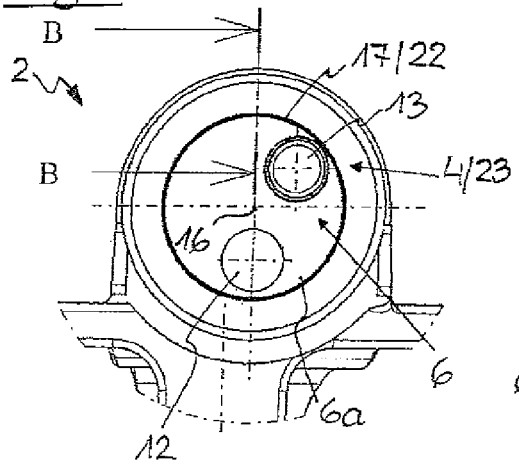
Figure 6:
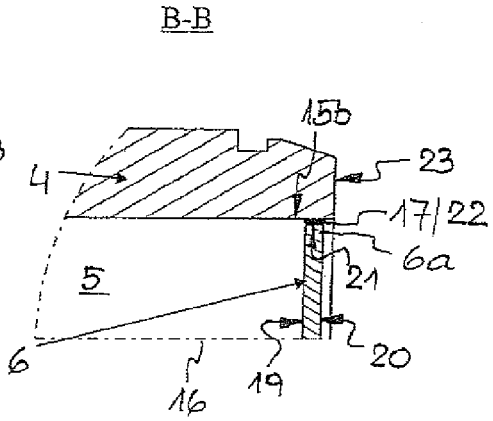

FIG. 5 a top view of a piston-cylinder unit of a coolant compressor according to the invention in alternative construction method FIG. 6 a sectional drawing of the piston-cylinder unit along line B-B in FIG. 5

Figure 7:
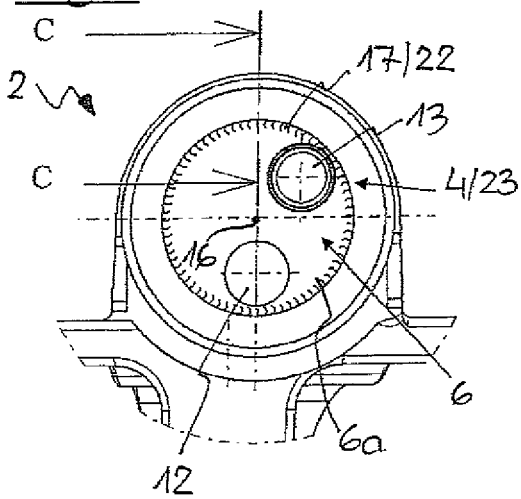
Figure 8:
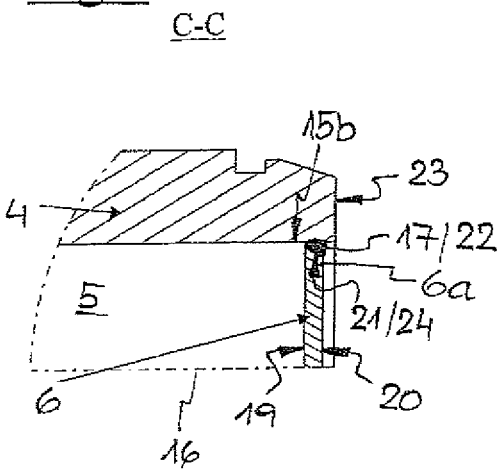

FIG. 7 a top view of a piston-cylinder unit of a coolant compressor according to the invention in alternative construction method FIG. 8 a sectional drawing of the piston-cylinder unit along line C-C in FIG. 7

METHODS FOR IMPLEMENTATION OF THE INVENTION

FIG. 2 shows a coolant compressor 1 according to the invention, comprising a piston-cylinder unit 2 that compresses a coolant, said piston-cylinder unit comprising a cylinder housing 4 and a piston 3 held in a piston bore 5 of the cylinder housing 4. To drive the piston 3 oscillating in the cylinder housing 4, a stator core 8 with a stator winding 18 is provided, inside which a rotor 9 is arranged. The rotor 9 set into rotation drives the piston 3 in a known manner via a crankshaft 10, to which a connecting rod 11 is linked, so that said piston completes a linear movement forwards and backwards along the axis 16.

The coolant compressor 1 visible in FIG. 2 is surrounded by a hermetically sealed housing that is not shown.

To limit a work area in which the coolant is compressed, said work area being formed by the piston bore 5 of the cylinder housing 4, the piston bore 5 is sealed in an axial direction by a valve plate 6. The valve plate 6 comprises an inlet opening 12 and an outlet opening 13, through which the coolant is sucked into the work area of the cylinder housing 4 or discharged from the same. In this case, the coolant is supplied to or conducted away from the intake or outlet openings 12, 13 by way of suction or pressure lines that are not shown.

Whilst the valve plate 6 together with the cylinder cover 7 is fastened at the cylinder housing 4 in a costly manner by way of screw elements 25 in the case of a piston-cylinder arrangement according to the state of the art, as shown in FIG. 1, it is thus provided according to the invention that the valve plate 6 be fastened at its relevant desired operating position in the piston bore 5 of the cylinder housing 4 by way of a material bond connection.

Optionally, a welded joint, a soldered joint or a glued joint can be used as material bond connection.

In this case, the valve plate 6 is fastened in the piston bore of the cylinder housing 4 in a simple manner by way of a binder layer 17 that is fluid or viscous at least while it is processed, thus by way of a weld seam, a solder layer or a glue layer.

According to the present embodiments, the valve plate 6 is designed as a cylindrical disk, which (with the exception of an annular gap) substantially covers the entire cross-section of the piston bore 5.

Instead of a single binder layer 17, it is naturally also possible to apply multiple binder layers 17 successively or side by side, e.g. the valve plate 6 can be glued twice or soldered twice to the cylinder housing 4 or the piston bore in order to ensure particularly high sealing properties.

It must be noted that it is also possible to produce the material bond connection between the valve plate 6 and the piston bore 5 of the cylinder housing 4 without the use of a binder layer 17 by merely heating the contact surfaces between the valve plate 6 and the piston bore 5 of the cylinder housing 4 thermally, e.g. by way of a laser or ultrasonic welding method, and melting these together.

In a first preferred design variant of the invention, the material bond connection between the valve plate 6 and the piston bore 5 of the cylinder housing 4 is a welded joint.

FIG. 7 shows in this case a top view of the piston-cylinder unit 2 in a viewing direction according to arrow 26, whereby a detailed sectional drawing along line C-C in FIG. 7 is shown in FIG. 8.

A gap 22 is designed between the outside circumference 15*b* of the piston bore 5 and an outside circumference 21 of the valve plate 6, in which it is possible to take up a binder layer 17, being a weld seam 17 in the present embodiment.

In the embodiment according to FIG. 8, the periphery 6*a* of the valve plate 6 is provided respectively with a chamfer 24, so that the gap 22 has a wedge-shaped course that tapers in the direction of the outside circumference 15*b* of the piston bore 5.

The second face 20 of the valve plate 6 can be positioned on the same level with the face 23 of the cylinder housing 4 (FIG. 2) or also fully countersunk in the piston bore of the cylinder housing 4 (FIG. 6, FIG. 8). It is also conceivable that the valve plate 6 is countersunk merely in sections in the cylinder housing 4, thus that the second face 20 of the valve plate 6 protrudes beyond the level of the face 23 of the cylinder housing 4.

All welding methods known in accordance with the state of the art can be used as welding methods for the production of a welded joint connecting the valve plate 6 to the cylinder housing 4 or the piston bore 5.

In a second preferred design variant of the invention, the material bond connection between the valve plate 6 and the cylinder housing 4 or the piston bore 5 is a soldered joint (shown in FIGS. 3-6). Principally, the same options exist for arrangement of the valve plate 6 in the cylinder housing 4 or in the piston bore, as described already on the basis of the embodiments.

Depending on the size of the waste space volume to be produced, the binder or solder layer 17 can be designed either plane with the faces 19, 20 of the valve plate 6, in particular plane with the first face of the valve plate 6 facing the piston 3, or also curved and protruding beyond the faces 19, 20 of the valve plate 6. Incidentally, the same options also exist in the case that the binder layer is implemented as a weld seam or as a glue layer.

All soldering methods known in accordance with the state of the art can be used as soldering methods for the production of a soldered joint connecting the valve plate 6 to the cylinder housing 4 or the piston bore 5.

In a particularly preferred third design variant of the invention, the material bond connection between the valve plate 6 and the cylinder housing 4 or the piston bore 5 is a glued joint (not shown extra—the same as that said for welded and soldered joints applies again in analogy with regard to the options for arrangement of the valve plate 6 and the binder or glue layer 17).

All glues known in accordance with the state of the art and usable in this context can be used as glues for the formation of a glue layer connecting the valve plate 6 to the cylinder housing 4 or the piston bore 5, thus both glues that can be applied in a heated condition as well as glues that can be applied cold.

The relevant binder layer provided for formation of the material bond connection—thus the weld seam, the solder layer or the glue layer 17—can either run along the entire circumference of the valve plate 6 or be arranged merely in sections along the circumference of the valve plate 6. In the latter case, for instance and merely by way of example, three binder layer sections 17*a*, 17*b* and 17 arranged equidistantly to each other are provided running along the circumference of the valve plate 6 over an angular section of approx 40° each. Tightness of the piston work area sealed by the valve plate 6 can also be guaranteed with just partial fastening of the valve plate 6, if the sections not joined together by material bond are sealed by a seal.

In the previously described embodiments, the valve plate 6 is designed as a single piece together with the cylinder cover. In other words, it is possible to omit the provision of a separate cylinder cover 7, as can be seen in the prior-art drawing according to FIG. 1. It is clear that the valve plate-cylinder cover element does not necessarily have to be designed plate-shaped in the case of a single-piece design of the valve plate 6 and the cylinder cover, but can be provided with any geometry.

Naturally, it is also possible to fasten the valve plate 6 in the piston bore 5 of the cylinder housing 4 by material bond in a manner described according to the invention and still provide a separately manufactured cylinder cover 7 that borders to or surrounds the valve plate 6 and is fastened at the cylinder housing. This can be expedient in particular in the case of special suction line and pressure line connections to the piston-cylinder unit 2.

In this case, significantly more connecting options than before are available for fastening the cylinder cover (not shown) at the cylinder housing 4, as the valve plate 6 does not have to be fastened tightly at the cylinder housing 4 by way of the cylinder cover 7.

The limitation of the waste space area mentioned already in the opening, namely a space inside the cylinder housing 4 that does not belong to the working volume of the piston 3, is a particularly critical point in the production of generic piston-cylinder units 2. In order to compensate operationally-related thermal expansions of the components of the piston-cylinder unit 2 and prevent hitting of the piston 3 at the cylinder cover 7 or at the valve plate 6, a clearly defined distance between the face 27 of the piston 3 positioned at its top dead center and a first face 19 of the valve plate 6 facing the piston 3 must always be provided for the formation of the waste space area.

According to the invention, it is therefore proposed as method for fastening the valve plate 6 at the cylinder housing 4 that the valve plate 6 is pushed into the piston bore 5 in an axial direction 26 (see FIG. 2) until a relevant defined distance or a desired waste space volume is created between the face 27 of the piston 3 positioned at its top dead center and the first face 19 of the valve plate 6 facing the piston 3. When this position of the valve plate 6 is reached inside the piston bore 5 (see FIG. 3), the valve plate 6 is welded or soldered or glued on in a manner already described.

It is clear that the piston 3 does not really have to be positioned at its top dead center when the valve plate 6 is mounted or when the valve plate 6 is pushed into the piston bore 5, but that the level at which the piston face 25 would be positioned when the piston 3 is at its top dead center position is used as reference point for measurement of the defined distance up to which the valve plate 6 is pushed into the piston bore 5. A distance measurement of this type can be made on the basis of suitable reference points or surfaces of the cylinder housing geometries, e.g. with reference to a cylinder housing face 23.

This way, the waste space volume of the piston-cylinder unit 2 can be limited exactly. A waste space volume with the smallest possible dimension results in a higher efficiency as well as an improved specific cooling capacity of the coolant compressor 1.

The invention claimed is:

1. A coolant compressor (1), comprising a piston-cylinder unit (2) that compresses a coolant, said piston-cylinder unit comprising a cylinder housing (4) and a piston (3) held in a piston bore (5) of the cylinder housing (4), wherein the piston bore (5) is sealed in an axial direction by a valve plate (6) and a cylinder cover (7), and the valve plate (6) is countersunk in its operating position in the piston bore (5) of the cylinder housing (4) and is fastened in the piston bore (5) of the cylinder housing (4) by way of a material bond connection between the valve plate (6) and the piston bore (5), so that an end stop provided especially for the valve plate (6) in the cylinder housing (4) can be omitted.

2. The coolant compressor according to claim 1, wherein the material bond connection is a welded joint.

3. The coolant compressor according to claim 1, wherein the material bond connection is a soldered joint.

4. The coolant compressor according to claim 1 herein the material bond connection is a glued joint.

5. The coolant compressor according to claim 1, wherein a gap (22) is designed between the outside circumference (15*b*) of the piston bore and an outside circumference (21) of the valve plate (6), in which it is possible to take up a binder layer (17) provided for formation of the material bond connection.

6. The coolant compressor according to claim 5, wherein the gap (22) has a wedge-shaped course that tapers in the direction of the piston bore (5).

7. The coolant compressor according to claim 6, wherein the wedge-shaped course of the gap (22) results from a chamfer (24) provided at the periphery (6*a*) of the valve plate (6).

8. The coolant compressor according to claim 1, wherein a binder layer (17) provided for formation of the material bond connection runs along the entire circumference of the valve plate (6).

9. The coolant compressor according to claim 1, wherein a binder layer (17) provided for formation of the material bond connection is arranged merely in sections along the circumference of the valve plate (6).

10. The coolant compressor according to claim 1, wherein the valve plate (6) is designed as a single piece together with the cylinder cover (7).

11. A method for fastening a valve plate (6) at a cylinder housing (4) of a coolant compressor (1), comprising:

the cylinder housing (4) is provided with a piston bore (5) for the uptake of a piston (3) that oscillates therein, and wherein a distance between the face (27) of the piston (3) positioned at its top dead center and a first face (19) of the valve plate (6) facing the piston (3) is provided for the formation of a waste space volume, thus a space inside the cylinder housing (4) that does not belong to the working volume of the piston (3), and wherein the valve plate (6) is pushed into the piston bore (5) in an axial direction (26), until a relevant defined distance or a desired waste space volume is created between the face (27) of the piston (3) positioned at its top dead center and the first face (19) of the valve plate (6) facing the piston (3), and the valve plate (6) is welded or soldered or glued on at this position in the piston bore (5) of the cylinder housing (4) between the valve plate (6) and the piston bore (5).

* * * * *